United States Patent [19]

Jones et al.

[11] 4,348,835

[45] Sep. 14, 1982

[54] AUTOMATIC DOOR OPENING DEVICE

[76] Inventors: Stanley Jones, 1918 Lake St., Holland, Mich. 49423; Willard Nyenbrink, 6549 Fillmore St., Allendale, Mich. 49401

[21] Appl. No.: 108,676

[22] Filed: Dec. 31, 1979

[51] Int. Cl.[3] ..... E05F 15/00

[52] U.S. Cl. ..... 49/139; 49/29; 49/140; 49/340; 49/345

[58] Field of Search ..... 49/139, 140, 340, 339, 49/333, 334, 345, 264, 29, 30, 386

[56] References Cited

U.S. PATENT DOCUMENTS

| | | | |
|---|---|---|---|
| 1,684,704 | 9/1928 | Hubbell | 49/139 |
| 2,298,542 | 10/1942 | Potter et al. | 49/139 X |
| 2,591,693 | 4/1952 | Gatesy | 49/139 X |
| 3,069,151 | 12/1962 | Cook et al. | 49/139 X |
| 3,081,994 | 3/1963 | Martens | 49/340 |
| 3,344,554 | 10/1967 | Misaka et al. | 49/139 X |
| 3,384,994 | 5/1968 | Daugirdas et al. | 49/139 X |
| 3,457,674 | 7/1969 | Catlett et al. | 49/340 |
| 3,470,653 | 10/1969 | Kalog | 49/139 |
| 3,508,362 | 4/1970 | Wright | 49/340 |
| 3,708,915 | 1/1973 | Davey | 49/340 |
| 3,874,117 | 4/1975 | Boehm | 49/340 X |
| 4,007,557 | 2/1977 | Davis et al. | 49/139 |
| 4,121,382 | 10/1978 | Dietrich et al. | 49/334 |

*Primary Examiner*—Philip C. Kannan

*Attorney, Agent, or Firm*—Waters, Lesniak & Willey

[57] ABSTRACT

An auxiliary door opening device comprises an extendible motor driven rotatable output shaft that engages and rotates a pivot shaft of a conventional door closing mechanism. The pivot shaft is drivingly connected to a pair of pivotally connected arms of the door closing mechanism, such that rotation of the pivot shaft causes the arms of the door closing device to pivot, urging the door open. The door opening device is activated by a remote switching device so that a handicapped person may open the door with a minimum of effort. A limit switch causes the motor to shut off and the output shaft to retract out of engagement with the pivot shaft when the door is fully opened. A solenoid apparatus holds the door open long enough to allow a handicapped person to pass through the door before allowing the door closing mechanism to urge the door closed. When not actuated by the switching device, the door opens manually and the door closing mechanism controls door closing in its normal manner, unaffected by the door opening device.

17 Claims, 3 Drawing Figures

AUTOMATIC DOOR OPENING DEVICE

BACKGROUND OF THE INVENTION

1. Field of the Invention

The present invention relates to a power-assisted auxiliary door opening designed for use in connection with a conventional door closing mechanism so that a door may be opened with minimal physical effort by a handicapped person by way of a remote switch mounted on the door or the door jamb.

2. Description of the Prior Art

A door closing mechanism is a commonly used device for automatically closing a conventional access door at a given rate of speed and thereafter holding the door closed with a predetermined pressure. The closing pressure is selected so that the door can not be blown open or held open by the wind.

A typical door closing mechanism comprises a rotation control unit mounted in a housing on the door (or door jamb) and a pair of pivotally connected arms interconnecting the door jamb and the housing. Rotation of the door causes a pivot shaft to rotate in the housing, and the control unit (which is connected to the pivot shaft by way of a rack and pinion gear) controls the rate of closing the door. In the control unit, the rack gear is connected to a piston such that longitudinal movement of the gear causes the piston to compress an oil dampened spring. Upon release of the door, the spring causes the door to close, and the oil damping system regulates the speed at which the door closes.

New Federal Regulations require that access doors in commercial establishments be operable by handicapped persons employing no more than about six pounds of pressure. This causes a problem because most door closers hold the doors shut with substantially more than six pounds of pressure, and six pounds of pressure may be insufficient to hold a door closed against the pressure of a strong wind.

A number of automatic door opening devices are on the market but such devices are cumbersome, expensive and require complete replacement of the conventional, manually operable door mechanism.

One object of the present invention is to provide an effective yet inexpensive door opening device that permits a door to be held closed with substantial force while allowing a handicapped person to open the door easily.

Another object of the present invention is to provide an auxiliary door opener that can be easily installed in connection with a conventional door closing mechanism as an add-on kit.

Another object of the present invention is to provide an auxiliary door opening device that permits the door to be opened manually by non-handicapped persons and automatically by handicapped persons.

SUMMARY OF THE INVENTION

The present invention comprises an auxiliary door opening device adapted for use by handicapped persons or the like in connection with a conventional door closing mechanism. The conventional door closing mechanism includes a pair of pivotally connected arms extending between the door and a door jamb and rotation control means connected to at least one of the arms for urging the arms to pivot so as to close the door at a controlled rate of speed. The auxiliary door opening device comprises a power-assisted drive mechanism adapted to be connected to the door closing mechanism for positively rotating the arms so as to open the door when the drive mechanism is activated. A selective activation mechanism is employed for activating the drive mechanism to automatically open the door.

The drive means of the present invention is constructed and connected to the door closing mechanism such that the drive mechanism does not affect door rotation unless it is activated. Thus, the door may be operated manually in the absence of activation of the door opening device.

In a door closing mechanism wherein a housing is mounted on the door or door jamb and one end of the pivotally connected arms is attached to a rotatable pivot shaft mounted in the housing, the drive mechanism for the auxiliary door opening device is drivingly connected to the pivot shaft and forces rotation of the pivot shaft to open the door. The rotation control means also is attached to the pivot shaft in such apparatus and serves to control the rate of rotation of the pivot shaft.

Desirably the drive mechanism comprises an electrically operated drive motor having a rotatable output shaft that is connected to the pivot shaft by interconnected gears attached to the pivot shaft and output shaft. The activation means comprises an electrical switch electrically connected to the drive motor and positioned for convenient remote activation of the drive motor.

The output shaft of the drive motor is linearly movable into and out of the drive motor and extends outwardly so that the gears of the output shaft and pivot shaft become meshed in driving engagement when the motor is actuated. When the motor is deactuated, the gears disengage. The motor is actuated by a push button, card reader, or radio controlled actuator positioned for convenient access by a handicapped person. Upon actuation the motor remains actuated until the door is opened. At that point, the motor becomes deactuated and the gears become disengaged, so that the door closing mechanism can close the door in its normal manner, without having the door opening device affect the door closing characteristics. This also permits manual opening and closing of the door without any interference by the door opening device.

Another feature of the present invention is an interlock mechanism connected to the lock on the door, such that the automatic door opening device can not be activated when the door is locked.

Still another feature of the present invention is a door closer delay mechanism that holds the door open for a predetermined period of time after the door has been opened, before the door mechanism is permitted to close the door. The closer delay mechanism employed in the preferred practice of the present invention comprises a collar mounted for rotation on the pivot shaft, with the collar having an indented portion in the outer periphery thereof. A solenoided operated stop mechanism is positioned transversely to the collar and includes an extendible stop member that extends outwardly and engages the collar resiliently as soon as the door has opened fully. The stop member engages the indented portion of the collar and thereby holds the door in its open position until a timer mechanism releases the solenoid actuation and retracts the stop member, at which time the door is permitted to close.

Desirably the present invention can be manufactured and sold in a kit form, such that an existing door system having a conventional door closer mechanism can be converted to an automatic door opening device. Such a kit desirably includes a base plate which can be mounted on the door by the same fasteners used for the conventional door closer mechanism. The door closer mechanism then can be mounted over the base plate by the same fasteners. In some applications it may be desirable to substitute reinforced arms in the conventional door closing mechanism in order to provide sufficient strength for the arms to open the doors as well as close the door.

These and other features and advantages of the present invention are discussed below. For purposes of illustration, but not of limitation, preferred embodiments of the present invention are described below and shown in the attached drawings.

DETAILED DESCRIPTION OF THE PREFERRED EMBODIMENTS

Figure 1:
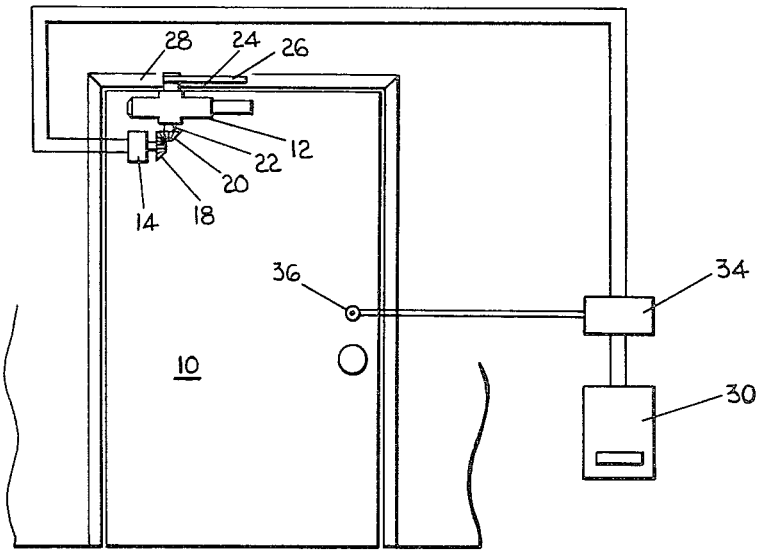
FIG. 1 is a front elevational view showing in partially schematic form the door opening device of the present invention installed on a door in connection with an existing door closing mechanism.
Figure 2:
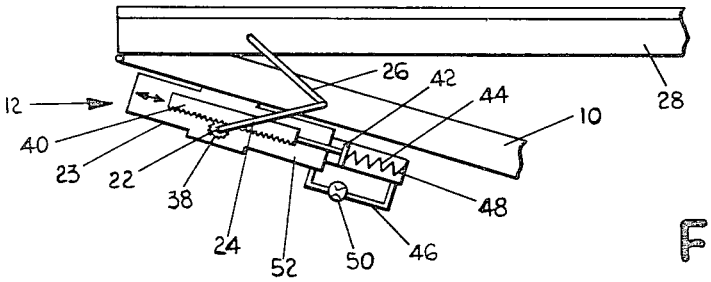
FIG. 2 is a top plan view showing in schematic form a conventional door closing mechanism mounted on a door assembly.
Figure 3:
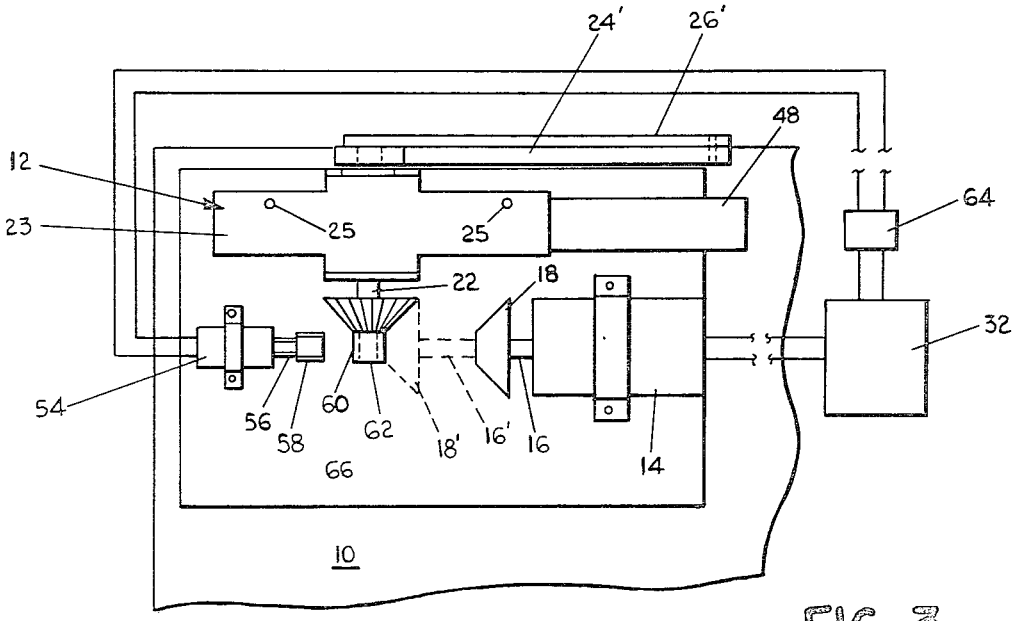
FIG. 3 is a front elevational view showing in partially schematic form the door opening device of the present invention installed in connection with an existing door closing mechanism and further illustrating the closer delay means.

Referring to FIGS. 1 through 3, the door opening device 11 of the present invention is shown installed on door 10, to operate in connection with a typical existing door closing mechanism 12.

The door opening device comprises an electric motor 14 having a rotatable output shaft 16 upon which bevel gear 18 is mounted. Bevel gear 18 can be selectively meshed with gear 20, which is mounted on a pivot shaft 22 pivotally mounted in a housing 23 of the door closing mechanism 12, the housing being attached to the door by fasteners 25. Pivot shaft 22 is connected to arm 24 which is pivotably connected to arm 26 whose free end is hingedly connected to door jamb 28. The housing alternatively could be mounted on the door jamb.

The motor 14 is activated by way of an electric card reader 30 (FIG. 1) or by a radio-controlled, push button or similar actuator 32 (shown schematically in FIG. 3). An interlock mechanism 34 actuated by the door lock 36 prevents the door opening device from being operated when door 10 is locked by means of lock 36.

Door closing mechanism 12 includes pinion gear 38 which is mounted on pivot shaft 22. Pinion gear 38 meshes with rack 40 such that when door 10 is opened and pivotal movement of arms 24 and 26 causes pivot shaft 22 and pinion gear 38 to rotate, rack 40 extends laterally to retract piston 42 and to compress spring 44. As piston 42 retracts, oil damping system 46 allows oil to flow from chamber 48 through a check valve 50 into chamber 52. When door 10 is released, spring 44 urges piston 42 and rack 40 to return to their original positions. As rack 40 moves laterally to its original position, it causes pinion gear 38 and pivot shaft 22 to rotate, which in turn cause arms 24 and 26 to pivot in such a manner as to urge door 10 to a closed position. As piston 42 returns to its original position, the oil in chamber 52 flows through valve 50 back to chamber 48 at a controlled, predetermined rate of speed in order to regular the speed at which door 10 is closed.

Another feature of the present invention is that motor 14 has an extendible output shaft 16. When motor 14 is activated, rotatable output shaft 16 and gear 18 automatically extend outwardly from motor 14 to positions 16′ and 18′ into engagement with gear 20 on pivot shaft 22 to open the door. As soon as the door is fully opened, they return to their retracted positions 16 and 18 respectively. Thus, the door can close without engaging motor 14.

Another advantage of the extendible output shaft is that if the motor is not actuated to open the door, the door can be opened manually, and the door opening device has no effect on this manual operation.

Simultaneously with the deactivation of motor 14 and the retraction of its putput shaft 16, a closer delay solenoid 54 is actuated to extend an extendible output member 56. A roller 58 is transversely and rotatably mounted at the end of extendible output member 56 such that when extended it engages an indented portion 60 of an annular collar 62, which is mounted on pivot shaft 22. When roller 58 is fully extended by way of extendible output member 56, it engages the indented portion 60 to restrain rotation of annular collar 62, and this in turn restrains pivotal movement of pivot shaft 22. The restraining of the rotation of annular collar 62 and pivot shaft 22 prevents door closing mechanism 12 from operating, so that door 10 is held open for a predetermined holding time. A timer mechanism 64 regulates the duration of the holding time in accordance with its previously selected setting.

At the end of the predetermined holding time, timer 64 deactivates solenoid 54, which retracts extendible output member 56 and roller 58, thereby allowing annular collar 62 and pivot shaft 22 to rotate freely. The free rotation of pivot shaft 22 allows door closer 12 to operate normally to urge door 10 to its closed position.

All the components of the present invention as well as the door closing mechanism 12 are mounted on a single base or mounting plate 66 employing the same mounting holes as the original door closing mechanism. The single mounting plate makes it possible to conveniently and easily mount the apparatus to door 10 by using the same mounting holes in door 10 as the original installation of door closing mechanism 12. If necessary, as dictated by the design of an existing door closing mechansim 12, the original door closing mechanism's pivotal arms 24 and 26 can be replaced by reinforced pivotal arm 24′ and 26′ respectively in order to accommodate the loads presented by the various components of the present invention.

It should be understood that the foregoing represents merely an exemplary embodiment of the present invention and that various changes and modifications may be made in the arrangements and details of construction of the elements described and shown above without departing from the spirit and scope of the present invention.

The embodiments of the invention in which an exclusive property or privilege is claimed are defined as follows:

1. An auxiliary power-assisted door opening device for use in connection with a door closing mechanism that includes a pair of pivotally connected arms extending between a door and a door jamb and rotation control means connected to at least one of the arms for urging the arms to pivot so as to close the door at a controlled rate of speed, wherein the auxiliary door opening device comprises:

electromechanical drive means adapted to be mounted on the door or door jamb adjacent the rotation control means for positively pivoting the arms of the door closing mechanism so as to open the door when the drive means is activated, said electromechanical drive means comprising an electrical motor having a rotatable output shaft and a gear mechanism operably coupling the rotation control means to the output shaft of the motor, such that rotation of the output shaft causes the gear mechanism to mechanically drive the rotation control means to open the door; and selective activation means for activating the drive means to automatically open the door.

2. An auxiliary door opening device according to claim 1, wherein the drive means does not affect door rotation unless it is activated, such that the door may be operated manually in the absence of activation of the door opening device.

3. An auxiliary door opening device according to claim 1, wherein the door closing mechanism includes a housing mounted on the door or door jamb, with a rotatable pivot shaft being pivotally mounted in the housing and a free end of one of the arms being mounted on the pivot shaft for rotation therewith, the rotation control means being drivingly connected to the pivot shaft to control the rate of rotation of the pivot shaft, the drive means for the auxiliary door opening device also being drivingly connected to the pivot shaft for forcing rotation of the pivot shaft so as to open the door.

4. An auxiliary power-assisted door opening device for use in connection with a door closing mechanism that includes a housing mounted on the door or door jamb, a rotatable pivot shaft pivotably mounted in the housing, a pair of pivotally connected arms extending between a door and a door jamb with a free end of one of the arms being mounted on the pivot shaft for rotation therewith and rotation control means connected to the pivot shaft for controlling the rate of rotation of the pivot shaft to close the door at a controlled rate of speed, wherein the auxiliary door opening device comprises:

power-assisted drive means adapted to be connected to the pivot shaft of the door closing mechanism for positively rotating the pivot shaft so as to open the door when the drive means is activated, the drive means being disconnected from the pivot shaft except when activated to drive the pivot shaft, thus permitting manual operation of the door in the absence of activation of the automatic door opening device; and selective activation means for activating the drive means to automatically open the door.

5. An auxiliary door opening device according to claim 4, wherein:

the drive means comprises an electrically operated drive motor having a rotatable output shaft that is connected to the pivot shaft by interconnected gears attached to the pivot shaft and output shaft, with the gears becoming separated upon deactivation of the drive motor; and the selective activation means comprises an electric switch electrically connected to the drive motor and positioned for convenient remote activation of the drive motor.

6. An auxiliary door opening device according to claim 5, wherein the drive motor output shaft is linearly movable into and out of the drive motor between retracted and extended positions, one of said gears being mounted on the output shaft and the other being attached to the pivot shaft for rotation therewith, such that the gears enmesh when the output shaft is in its extended position and separate when the output shaft is in its retracted position, with rotation of the output shaft being in a predetermined direction such that the meshed gears urge the door to its open position when the drive motor is actuated, the output shaft being resiliently urged to its retracted position but being moved automatically to its extended position by an output shaft extend mechanism when the drive means for the auxiliary door opening device is activated.

7. An auxiliary door opening device according to claim 6, wherein the rotation control means comprises:

a pinion gear mounted on the pivot shaft for rotation therewith;

a rack gear movably mounted in the device in engagement with the pinion gear, the rack gear being moved by rotation of the pinion gear;

a resilient biasing means connected to the rack gear for resiliently urging the rack gear in a direction that causes the pinion gear to rotate the pivot shaft to close the door; and rotation retarding means for limiting the rate of speed at which the door closes.

8. An auxiliary door opening device according to claim 5, wherein the electric switch comprises an electric card reader.

9. An auxiliary power-assisted door opening device for use in connection with a door closing mechanism that includes a rotatable pivot shaft pivotally mounted on the door or door jamb, a pair of pivotally connected arms extending between a door and a door jamb with one of the arms being mounted on the pivot shaft for rotation therewith, and rotation control means connected to at least one of the arms for urging the arms to pivot so as to close the door at a controlled rate of speed, wherein the auxiliary door opening device comprises:

power-assisted drive means adapted to be connected to the pivot shaft of the door closing mechanism for positively rotating the arms so as to open the door when the drive means is activated, the drive means being constructed and connected such that it does not affect door rotation unless it is activated, such that the door may be operated manually in the absence of activation of the door opening device, the drive means being deactivated after the door is opened, thus permitting the door closing mechanism to close the door;

closer delay means for holding the door open for a predetermined, adjustable period of time before the door closing mechanism is permitting to close the door, the closer delay means comprising an electrically operated device that is actuated automatically upon the opening of the door by the drive means, the closer delay means restraining pivotal movement of the pivotally connected arms for the predetermined, adjustable period of time after the door has been opened and thereafter releasing the arms so that the door can be closed by the door closing mechanism, the closer delay means including means for resiliently engaging the pivot shaft when the door is open such that the door is held in its open position for said predetermined period of time, the closer delay means thereafter releasing the pivot shaft and permitting the door to close; and selective activation means for activating the drive means to automatically open the door.

10. An auxiliary door closing device according to claim 9 wherein the door closer delay means comprises a solenoid mounted in a fixed position with respect to the door closing mechanism, the solenoid having an extendible output member that moves between a retracted and extended position, a stop member being mounted on the end of the solenoid output member, the pivot shaft including holding means for engaging the stop member when the stop member is in its extended position, the holding means resiliently holding the pivot shaft in a predetermined open position when the stop member is extended into engagement with the holding means but releasing the stop member and permitting the door to close when the stop member is retracted.

11. An auxiliary door closing device according to claim 10 wherein the stop member comprises a roller rotatably mounted on the output member for rotation in an axis parallel to the pivot shaft, and the holding means comprises an annular collar mounted on the pivot shaft, the annular collar including an indented portion that is engaged by the extended roller of the stop member, the engagement between the roller and indented portion resiliently restraining rotation of the pivot shaft and holding the door open.

12. A kit for converting a conventional door closing mechanism to an auxiliary door opening device, wherein the door closing mechanism is mounted on a door or door jamb and includes an arm mechanism extending between the door and the door jamb, with the arm mechanism being movable in predetermined direction as the door is opened and closed, with movement control means being drivingly connected to the arm mechanism for urging the arm mechanism to close the door at a controlled rate of speed, the kit comprising:

electromechanical drive means adapted to be mounted on the door or door jamb adjacent the movement control means for positively moving the arm mechanism so as to open the door when the drive means is activated, said electromechanical drive means comprising an electrical motor having a rotatable output shaft and a gear mechanism operably coupling the movement control means to the output shaft of the motor, such that rotation of the output shaft causes the gear mechansim to mechanically drive the movement control means to open the door; and selective activation means for activating the drive means so as to cause the drive means to automatically open the door.

13. A kit according to claim 12 wherein the drive means and means for connecting the drive means to the arm mechanism are constructed such that the drive means does not affect door movement unless it is activated, the drive means being drivingly disconnected from the door closing mechanism when the door is closing and when the door is opened and closed manually.

14. A kit according to claim 12 and further comprising a base attachable to the door on which the door closing mechanism and door opening mechanism are mounted, the base being attachable to the door and the door closing mechanism being mounted on the base by the same fastener openings used for the door closing mechanism alone.

15. A kit according to claim 12 further comprising a reinforced arm mechanism that is replaceable for the existing arm mechanism on the door closing mechanism.

16. A kit according to claim 12 wherein the kit further comprises closer delay means for delaying the closing of the door for a predetermined time after it is opened and interlock means for deactivating the selective activation means when the door is locked.

17. A door opening and closing device comprising:

a housing mounted on the door or door jamb and having a pivot shaft rotatably mounted therein;

a pair of pivotally connected arms extending between a door and a door jamb, one of the arms being mounted on the pivot shaft for rotation therewith, the arms being constructed and mounted such that rotation of the pivot shaft in both directions causes the door to open and close;

rotation control means resiliently connected to the pivot shaft for urging the arms to pivot at a controlled rate of speed to close the door;

electrically operated drive means attached to the door for engaging and positively rotating the pivot shaft so as to open the door;

means for disconnecting the drive means from driving engagement with the pivot shaft except when the drive means is activated such that the door may be opened manually without significant rotation impeding effect from the drive means when the drive means is not activated; and selective activation means for activating the drive means so as to cause the drive means to automatically open the door and for deactivating the drive means such that the rotation control means is allowed to close the door.

* * * * *